United States Patent [19]

Avédissian

[11] 3,974,662

[45] Aug. 17, 1976

[54] ANNULUS OF JOINED SETTINGS WITH FILIFORM CLAW ELEMENTS

[76] Inventor: Sérop Avédissian, 6, rue de la Grange Bateliere, Paris 90, Seine, France

[22] Filed: Jan. 17, 1974

[21] Appl. No.: 434,050

[52] U.S. Cl. ..... 63/15; 63/28; 29/160.6

[51] Int. Cl.[2] ..... A44C 9/00; A44C 17/02

[58] Field of Search ..... 63/27, 28, 15, 26; 29/160.6

[56] References Cited

UNITED STATES PATENTS

| | | | |
|---|---|---|---|
| 664,725 | 12/1900 | Costigan | 63/28 |
| 694,594 | 3/1902 | Wittstein | 63/27 |
| 1,001,377 | 8/1911 | Fairbrother | 63/28 |
| 1,567,516 | 12/1925 | Kirchner | 63/26 |
| 2,070,157 | 2/1937 | Dinhofer | 63/27 |
| 2,265,956 | 12/1941 | Schenck | 63/27 |

FOREIGN PATENTS OR APPLICATIONS

| | | | |
|---|---|---|---|
| 568,919 | 1/1924 | France | 63/15 |
| 565,891 | 11/1923 | France | 63/15 |
| 791,944 | 3/1958 | United Kingdom | 63/28 |
| 1,047,829 | 11/1966 | United Kingdom | 63/28 |

*Primary Examiner*—F. Barry Shay
*Attorney, Agent, or Firm*—Hill, Gross, Simpson, Van Santen, Steadman, Chiara & Simpson

[57] ABSTRACT

A ring shaped article of jewelry comprises a body having an assembly of settings supporting stones set therein, the settings being arranged side-by-side and fixed to each other, and a stone-retainer comprising a generally omegoid loop having extremities secured in the juncture between contiguous settings and a loop portion projecting outwardly from the juncture, filiform claw elements having respective one end portions thereof secured to the settings and opposite end portions protectively engaged within said loop portion, and intermediate portions of said elements extending around adjacent parts of said loop portion and retainingly engaging the stones.

13 Claims, 9 Drawing Figures

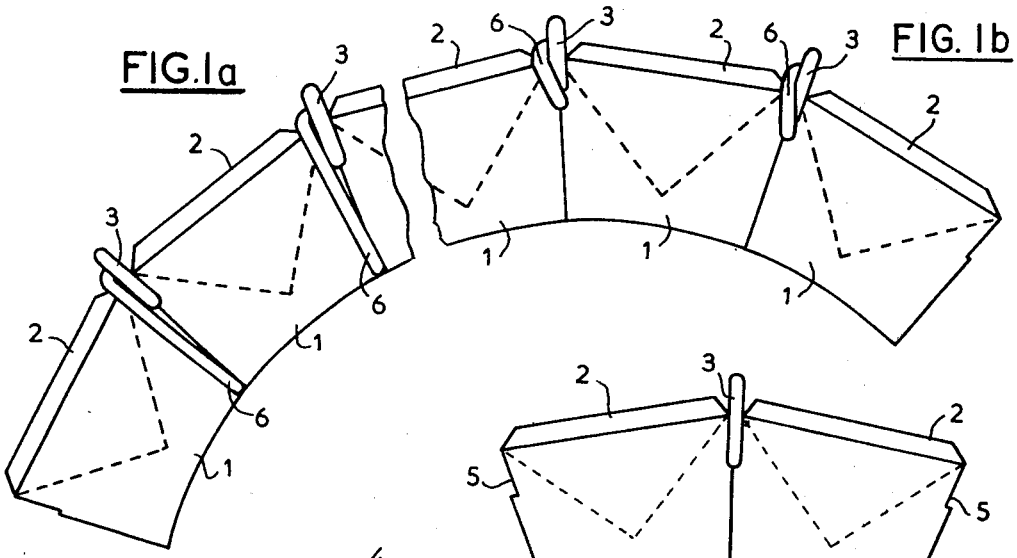
FIG.1a
FIG. 1b
1
2
3
6
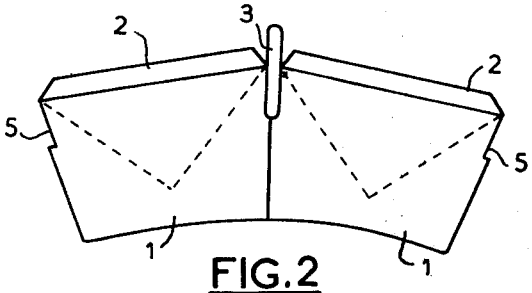
FIG.2
1
2
3
5
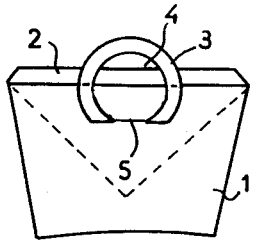
FIG.3
1
2
3
4
5
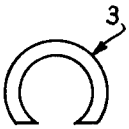
FIG.4
3
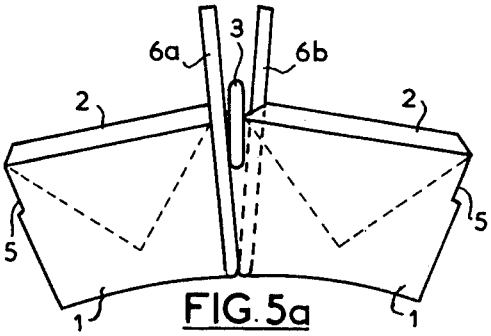
FIG.5a
1
2
3
5
6a
6b
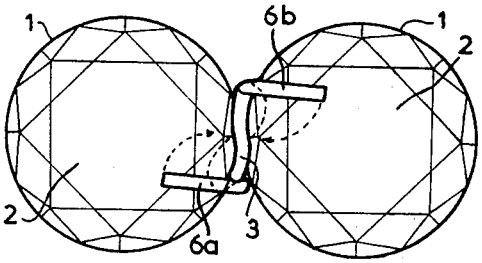
FIG.6a
1
2
3
6a
6b
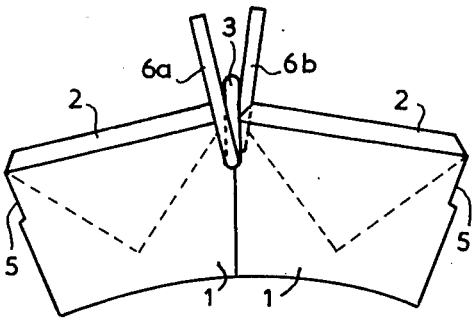
FIG. 5b
1
2
3
5
6a
6b
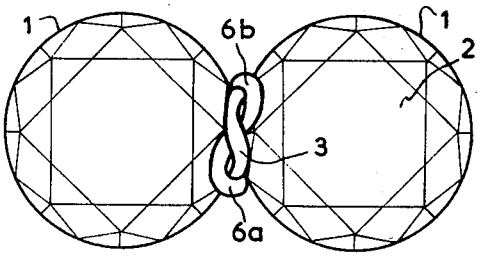
FIG.6b
1
2
3
6a
6b

ANNULUS OF JOINED SETTINGS WITH FILIFORM CLAW ELEMENTS

This invention also relates to stone retainers for ring shaped articles of jewelry such as wedding rings, and is especially applicable to the manufacture of wedding rings having a row of stones arranged over the whole of their periphery or over a part of the periphery only.

The setting of stones is obtained, in the present state of technique, in three different ways. Following a first known process, more especially applicable to isolated stones, the stone is held on the ring by means of claws made of the same metal as the ring, welded on the body of the ring and uniformly arranged around the stone, the claws being engaging the stone and having their extremities bent back over the edges of the said stone in order to hold it fixed on the ring. According to a second method, the stones are enchased in bezels and are held fixed in the bezels by means of claws welded on the latter, uniformly distributed around the stone and bent back on to this latter so as to keep it fixed in its bezel. In a a third method, the stones are fitted in a straight or festooned gold casing and are held fixed in it by means of ears of metal raised in the metal edges and bent back over the edges of the stone.

These various methods of fixing and setting stones in a ring make it possible to obtain satisfactory fixing, but they have the disadvantage of causing a slight deterioration of the edges of the stones, which adversely affects their value. In addition, the setting has the effect of masking part of the stone, thus preventing it from being as fully displayed as it might be. Finally, the wearers of these rings of ten complain that the rings having the stones inset by means of claws or ears catch in the fabrics of clothing by the claws and cause damage to certain materials, especially when they are thin.

The present invention obviates these disadvantages by providing means for setting stones in a ring or wedding ring which does not cause any damage to the mounted stones and leaves their edges quite free, thus enabling them to be shown to better advantage, and which furthermore permits the production of wedding rings in which the mounting and setting of the stones do not catch in the materials of the clothing in which they may occassionally come into contact.

In addition, the wedding rings obtained by this means possess, from the aesthetic aspect, the particular feature of giving the impression that the stones have been set by means of twisted wires surrounding the wedding ring and holding the stones in position, giving the impression of surrounding them over the entire periphery of the ring.

In order to set or mount stones on a wedding ring according to the invention, the work is started on a wedding ring formed by a group of fitting settings for each of the stones, all identically the same, having a frusto-conical shape, arranged side-by-side and fixed to each other at the level of their small base and arranged in such manner that their axes are angularly distributed in a uniform manner in the same plane around the centre of the ring at which they are concurrent, the small bases of the said settings being turned towards the centre of the ring. On a ring thus constituted or fixed, in a first stage, in each of the spaces separating two successive settings, a retainer is constituted by a portion of a generally omegoid loop, made from a filiform metal element, by welding its extremities in the junction between the two settings, a portion of the loop projecting radially outwardly from the junction and with a portion of its eye exposed and providing an opening between its internal face and the adjacent portions of the external faces of the corresponding settings. Then in a second stage, there are fixed on each setting, two claws, comprising metal filiform elements, having their extremities passing beyond the radially outer edges of the settings by a pre-determined length, both arranged along a generator line of the outer lateral face of the setting, the first of these claws being placed on one side of the equatorial plane of the ring for engagement with the adjacent part of the respective one of the loops contiguous two retaining to the setting, and the second claw being placed along the generator line of the setting diametrically opposite to that along which the first claw is fixed and which for that reason is placed with respect to the first on the opposite side of the equatorial plane and is arranged for engagement with the adjacent part of the other retaining loop contiguous to the said setting, whereby when the fixing of the claws on the ring is finished, the ring has two rows of claws on each side of its equatorial plane, arranged to provide a pair at each retaining loop, one on one setting, the other on the contiguous setting and diverging towards the exterior of the ring.

When the loops is thus provided with its stone-retaining rings and claws, the stones are introduced into the settings, and then at the position of each retaining loop, the two claws adjacent to said loop are bent substantially at a right angle in a plane parallel to the equatorial plane and, in opposite directions, the claw fixed to one setting being bent over onto the other setting.

The bent-over portion of each claw is then bent to entwine it around the adjacent portion of the retaining loop in such manner as to place the distal extremity of the claw protectively in the opening of the loop under the internal face of the latter, the length of the claw being such that its extremity does not project beyond the contour of the ring. At the same time the projecting portion of the retaining loop is deformed in order to give it a generally ogee bent shape complementary to the entwined claws, each bend of the loop portion being engaged on one of the stones fitted into one of the settings, each stone being thus retained on a setting on one side by the entwined claw fixed to the adjacent setting and by a part of the bent retaining loop, and on the opposite side by the entwined claw fixed to the other adjacent setting and by a corresponding part of the bent retaining loop.

According to a first embodiment, the filiform element claws are fixed by welding over the entire length of a generator line of the setting.

According to a second embodiment, the filiform element claws are fixed by inserting one of their extremities into a retaining hole formed in the setting and by welding a remaining portion of the claw previously bent back at its outlet from the said retaining hole, and welded along the length of the generator line of the setting passing through the centre of the said orifice.

According to another characteristic feature, the wires employed for making the retaining loop and the twisted claws may have a true circular section or a polygonal section.

Other characteristic features and advantages of the invention will be more clearly brought out in the description which follows below, reference being made to the accompanying drawings, in which:

FIG. 1*a* is a side elevational view of a portion of a ring comprising stones mounted according to the present invention.

FIG. 1*b* is a fragmentary side elevational view showing a modification;

FIG. 2 is a fragmentary side elevational view of an assembly of two contiguous settings for the mounting of stones, provided with the loop part of the retaining device for the said stones;

FIG. 3 is a view looking toward the edge of a setting provided with the retaining loop of FIG. 2;

FIG. 4 side elevational view of the retaining loop of FIGS. 2 and 3;

FIG. 5*a* is a side elevational view of a group of two stone-carrying settings provided with the stone-retaining device and demonstrating how two claw members are fixed to the settings, to provide the retainer embodiment of FIG. 1*a;*

FIG. 5*b* is a side elevational view of a group of two adajcent settings demonstrating how they are provided with a stone-retaining device according to the embodiment of FIG. 1*b;*

FIG. 6*a* is a plan view of a group of two adjacent settings provided with the stone-retaining device and shows the claw members in their first stage of being bent toward the retainer loop; and FIG. 6*b* is a plan view similar to FIG. 6*a*, showing the final stage of bending back of the two claws into the loop.

In these figures, the same reference numbers have been given to the same parts.

Referring now to the drawings, a wedding ring provided on its periphery with inset stones following the method according to the invention comprises an assembly of settings 1, in each of which is fitted a stone 2. These identical settings are of slightly frusto-conical shape assembled together and welded edge-to-edge in succession in such manner that when thus joined to each other, their assembly forms a circular ring of which only an arc is shown in FIGS. 1 and 1*b*, the small bases of the frusto-conical elements constituting the settings being placed toward the inside of said ring which forms the annulus of the wedding ring. In order to retain the stones 2 fitted into the settings 1, the procedure is as follows: between each two successive settings, for example the settings 1 shown in FIG. 2, and in a small free space left between these two settings by confronting recesses 5, there are welded the extremities of a portion of a retainer ring or loop 3 having the generally omegoid shape shown in FIG. 4, the diametral plane of the said retainer loop coinciding with the central plane of the finger ring constituting the plane of symmetry of the two settings assembled together, while each of the extremities of the retainer loop 3 is welded to both of the opposite faces in the recesses 5 of the two settings and on the metallic portion constituting the welding point which fixes together the two said settings.

As shown in FIGS. 1*a* to 5*b*, each retainer loop 3 projects towards the exterior of the ring, leaving between a large part of the inner wall of the loop and the contiguous portions of the outer faces of the two adjacent settings a loophole 4 (see FIG. 3). This loophole 4 is arranged opposite the clearance provided by the recesses 5 (see FIG. 3) in the form of an arc of a circle provided on each setting symmetrically on each side of the equatorial plane of the wedding ring.

When the stone-retaining loops 3 have been fixed on the body of the wedding ring, that is to say when a retaining loop 3 is provided in all the spaces existing between two successive settings, there are welded on each setting, between its small end and its large end, two straight claws 6 of predeterminated length both having the same length, placed on the opposite sides of the wedding ring, each along a generator line of the setting and supported along the adjacent part of the retainer loop 3, as shown in FIG. 5*a*.

The claws 6 are arranged in groups of two alternately on one face of the wedding ring and on the opposite face, so that when the claws 6 are welded, the space comprised between two successive settings includes, as shown in FIG. 5*a*, in addition to the retaining loop 3, two claws 6*a* and 6*b* arranged one on one side of the wedding ring, the other on the opposite side of this ring, the two said claws diverging towards the exterior of the said ring on each side of the central plane of the ring passing through the retaining loop 3, the same arrangement being repeated at each space separating two successive settings.

In an alternative form (FIG. 5*b*), the claws 6 may be fixed on the settings by providing a hole in the latter in the vicinity of the base of the retaining ring, this hole having the same diameter or the same straight section as that of the claw, and introducing one extremity 8 of the claw into said hole and welding it on the lateral outer face of the setting along the generator line of this latter, passing through the hole after having bent back the extremity of the claw at its outlet from said hole.

In this last method (FIG. 5*b*) of fixing the claws on the settings, the said claws are only fixed on a part of the length of a generator line of a setting, but, apart from this difference, they each have the same arrangement with respect to the others and with respect to the retaining ring, as in the case described above (FIG. 6*a*), the space separating two settings then having the shape shown in FIG. 5*b*.

When the retaining loop 3 and the claws 6 have been fixed on the body of the wedding ring, as stated above, either according to the first or the second method, the stones are fitted as and when the shaping of the claws is effected. To this end, in a first stage, the two claws 6*a* and 6*b* adjacent to a retaining loop 3 and arranged on each side of the latter are first bent over to a right angle in the vicinity of the outer edges of the settings (FIG. 6*a*), the distal extremity of each claw being bent toward the setting on which it is not fixed, after which the projecting portion of the retaining loop 3 is slightly bent so as to give it a generally ogee shape as shown in FIG. 6*a*.

In a second stage, each of the two claws 6*a* and 6*b* is successively bent back around the adjacent part of the previously-bent retaining loop 3, in such manner that their distal extremities join each other within the loop 3 in the loopholes 4 and 5 the space provided by the recesses, and retainingly engaging on the corresponding stones (FIG. 6*b*).

When these bending operations are completed, a stone 2 fitted in the setting is retained on one side by the intermediate shoulder part of a bent claw 6*a* welded to this setting and engaging said stone, and a bent portion of the retaining loop 3 engaging on the said stone, and on the other side by the intermediate shoulder portion of the claw 6*b* welded on the same setting and engaging on said stone, but on the side opposite to the first. In other words, the assembly of the bent members fixed at a juncture between two settings in each of which a stone is fitted, permits the retention, respectively, of the two stones at the same time by the rounded shoulder bent portion of the claw **6*b* fixed to one of the settings, and by the rounded shoulder bent portion of the retaining loop located on the side of the claw 6*b*, while the stone of the second setting is held in its adjusted position simultaneously by the rounded shoulder bent portion of the claw 6*a* and by the rounded shoulder bent portion of the retaining loop 3 located on the side of the claw 6*b***.

When the same operations as above have been carried out for each of the stones of the wedding ring, the latter are inset and the said ring has the appearance of a wedding ring on which a succession of stones adjacent to each other are inset and surrounded by a twisted wire wound in a helix all round the wedding ring, each turn of the helix passing between two adjacent stones, which gives them an original aesthetic appearance.

The wedding rings, ornamented over their whole periphery, or a part of the latter, for example over one-third or one-half of the periphery, with stones inset by the method according to the invention, have the advantage, in addition to the aesthetic effect referred to, of having only rounded parts which exclude all risk of catching in clothing. In addition, as the stones are only fixed at two diametrically-opposite points, they are well cleared and are thus shown to better advantage.

It is clear on the one hand that the wires employed for the manufacture either of the retaining loop or of the shaped claws may have a section which is not necessarily circular but may be polygonal, for example triangular, square or rectangular, and on the other hand that the wedding ring may comprise juxtaposed and inset stones as described above, over part only of its contour.

It will of course be understood that the present invention has only been described and shown by way of preferred example, and that technical equivalents may be introduced in its constituent parts without thereby departing from its scope as defined by the appended claims.

I claim:

1. A ring shaped article of jewelry, comprising:

a body having an assembly of settings supporting stones set therein;

said settings arranged side-by-side and having fixed junctions; and a stone-retainer for each junction comprising:

a generally omegoid loop having extremities secured in the junction and a loop portion projecting radially outwardly from the junction;

filiform claw elements each having one end portion secured to one of the settings adjacent to the junction and an opposite end portion protectively engaged within said loop portion; and intermediate portions of the claw elements entwined around adjacent parts of the loop portion and retainingly engaging the stones;

each setting having two said claw elements secured thereto, said two claw elements each being entwined with the loop portion of a different said loop.

2. A ring according to claim 1, wherein said claw elements of each junction comprise two claw members one of which is secured to one of the settings at one side of the junction between the settings and the other of which is secured to the other setting at the opposite side of the junction, each of said claw members having a bend portion, the bend portion of the claw member at one side of the junction engaging about one part of said loop portion, and the bend portion of the claw member at the opposite side of the junction engaging about another part of the loop portion.

3. A ring according to claim 1, wherein said settings have opposed recesses in which said extremities of said loop are secured.

4. A ring according to claim 1, wherein said settings provide the body of the ring, each of the settings being of frusto-conical shape with the smallest diameter ends of the settings comprising bases which are aligned in side-by-side relation to provide an annular shape for the ring, said settings being welded together at the junctions and said loop extremities and said claw elements being welded to the settings.

5. A ring according to claim 1, wherein each of said claw elements has its one end portion secured along a generator line of a respective one of said settings adjacent to the junction, and said intermediate portions of the claw elements providing shoulders in retaining engagement with the respective stones.

6. A ring according to claim 1, wherein said settings have retaining holes therein, said one end portions of the claw members being fixed in said holes.

7. A ring according to claim 1, wherein said loop portion is of generally ogee shape providing oppositely projecting rounded shoulders engaging the stones.

8. A ring according to claim 1, wherein said intermediate portions of the claw elements provide rounded shoulder bends engaging the stones.

9. A ring according to claim 1, wherein said loop portion and said claw elements provide rounded shoulders retainingly engaging the stones.

10. A ring shaped article of jewelry, comprising:

a body having an assembly of settings supporting stones set therein;

said settings being arranged side-by-side and having fixed junctions;

a stone-retainer at each of said junctions comprising a generally omegoid loop having extremities secured in the junction and a loop portion projecting radially outwardly from the junction and having stone-retaining shoulder bends therein retainingly overlying the stones, and filiform claw elements located at respectively opposite sides of the ring and each having one end portion secured to one of the settings and an opposite end portion protectively engaged within the loop portion and with an intermediate portion of each of the claw elements entwined around and adjacent part of the loop portion and retainingly engaging one of the stones;

said intermediate portions of the claw elements providing rounded shoulders in engagement with the stones; and said settings providing a body for the ring, with each of the settings being of frusto-conical shape with the smallest diameter ends of the settings comprising bases which are aligned in side-by-side relation to provide an annular shape for the ring, the settings being welded together at the junctions and said loop extremities and said claw elements being welded to the settings.

11. A ring according to claim 10, wherein each of said claw elements has its one end portion secured along a generator line of a respective one of said settings adjacent to the junction, and said intermediate portions of the claw elements providing shoulders in retaining engagement with the respective stones.

12. A ring according to claim 10, wherein said settings have opposed recesses in which said extremeties of said loop are secured.

13. A ring according to claim 10, wherein said settings have retaining holes therein, said one end portions of the claw members being fixed in said holes.

* * * * *